United States Patent [19]

Steingroever

[11] 4,063,970

[45] Dec. 20, 1977

[54] METHOD OF MAKING PERMANENT MAGNETS

[75] Inventor: Erich A. Steingroever, Bonn, Germany

[73] Assignee: Magnetfabrik Bonn G.m.b.H. vormals Gewerkschaft Windhorst, Bonn, Germany

[21] Appl. No.: 598,342

[22] Filed: July 23, 1975

Related U.S. Application Data

[60] Division of Ser. No. 101,108, Dec. 23, 1970, abandoned, which is a continuation of Ser. No. 706,064, Feb. 16, 1968, abandoned.

[30] Foreign Application Priority Data

Feb. 18, 1967 Germany ..... 72816

[51] Int. Cl.[2] ..... H01F 1/02

[52] U.S. Cl. ..... 148/103; 148/31.57; 264/22; 264/24; 264/111; 264/115; 264/104; 252/62.54; 252/62.55

[58] Field of Search ..... 264/111, 115, 122, 104, 264/DIG. 58, 22, 24; 148/11.5 P, 103; 252/62.54, 62.55

[56] References Cited

U.S. PATENT DOCUMENTS

| | | | |
|---|---|---|---|
| 1,669,648 | 5/1928 | Bandur | 264/123 |
| 2,979,401 | 4/1961 | Szymaszek | 264/111 |
| 3,216,074 | 11/1965 | Harrison | 264/111 |
| 3,663,317 | 5/1972 | Westendorp et al. | 264/111 |

*Primary Examiner*—Robert F. White
*Assistant Examiner*—James R. Hall
*Attorney, Agent, or Firm*—George H. Mitchell, Jr.

[57] ABSTRACT

Method of making an anisotropic permanent magnetic body which has a $(B.H)_{max}$ of at least $1.4 \times 10^6$ Gauss . Oersted and a remanence of at least 2500 Gauss, utilizes magnetic powder particles having a coercivity $_JH_C$ at least equal to the actual remanence $B_r$ of the finally prepared magnetic body, a remanence $4\pi J_r$ equal to about 1.3 to 1.6 of the actual remanence $B_r$ of the finally produced magnetic body and a fullness factor $$\frac{(4\pi J \cdot H)_{max}}{4\pi J_S \cdot {}_JH_C}$$

which is at least 0.6.

7 Claims, No Drawings

METHOD OF MAKING PERMANENT MAGNETS

This application is a division of application Ser. No. 101,108, filed Dec. 23, 1970, now abandoned, which is a continuation of application Ser. No. 706,064, filed Feb. 16, 1968, now abandoned.

This invention relates to a method of making anisotropic permanent magnetic bodies and more particularly to flexible permanent magnets prepared by compacting an anisotropic permanent magnetic powder and a binder.

The magnetic values of such permanent magnets have been relatively low. If, e.g., barium ferrite is being used as starting material, the magnets prepared by known procedures have at best, about the following values:

$B_r = 2.200$ Gauss:

${}_JH_C = 1.480$ Oersteds $(B \cdot H)_{max} = 1.08 \cdot 10^6$ G. Oe.

These values are obtained when, in accordance with presently accepted theory, a material of high coercivity and low permeability is used.

It is a principal object of this invention to provide a method of making anisotropic permanent magnets which have improved magnetic properties and particularly higher $(B \cdot H)_{max}$ values than the magnets which are available at present.

Other objects and advantages will be apparent from a consideration of the specification and claims.

The invention is based on the discovery that, contrary to the generally accepted theory, the $(B \cdot H)_{max}$ value of permanent magnets prepared by compacting an anisotropic magnetic powder does not increase indefinitely with increasing ${}_JH_C$ values of the powder but that it passes through a maximum.

According to the invention, optimum magnetic values of a compacted magnet are obtained by employing as a starting material a powder of an anisotropic magnetic material which has the following properties:

1. A coercivity ${}_JH_C$ which is at least equal to the remanence of the magnet made therefrom and which is preferably 2800 Oe and higher, and, in view of the other required properties, not the maximum obtainable value;

2. A remanence $4\pi J_R$ which is about 1.3 to 1.5 times the remanence $B_R$ of the finished magnet, and particularly 1.2 to 1.6 · 2800 G, and 3. A fullness factor $$\frac{(4\pi J \cdot H)_{max}}{4\pi J_R \cdot {}_JH_C}$$

which is at least 0.6.

A preferred starting material for the preparation of an anisotropic permanent magnetic body according to the invention is a barium ferrite having the above recited properties. Also ferrites in which the barium is partly or completely replaced by strontium or lead can be used, provided they satisfy the above conditions.

Instead of ferrites, magnetic alloys such as Alnico alloys, Mn-Bi or Mn-Al or also Co-Y alloys may be employed.

The method of obtaining an anisotropic permanent magnetic material from such starting materials is well known. The powdered material, preferably in the form of magnetic domains, is compacted under pressure in a magnetic field so as to orient the domains in a principal direction. The compacted body is then sintered.

I have found that the sintering temperature has a profound influence on the magnetic properties of the obtained powder and that there is an easily determined optimum sintering temperature where highest $(B \cdot H)_{max}$ values are obtained. When said temperature is exceeded, the $(B \cdot H)_{max}$ values decrease. In order to obtain optimum values, it is also important to stop heating when the sintered body has reached full remanence. If heating is continued, the crystals grow, which results in a decrease of the coercitive force.

For the preparation of flexible magnetic materials, the anisotropic magnetic powder obtained by comminution of the sintered bodies are mixed with a suitable non-magnetic organic binder, e.g., an epoxy resin.

The invention will be described more in detail with reference to the following example for the preparation of an anisotropic permanent magnet.

For the preparation of a flexible magnet having a $(B \cdot H)_{max}$ of $1.6 \cdot 10^6$ G · Oe and a remanence $B_R$ of 2800 G, the starting ferrite material having the following proportions was used:

$B_R = 1.3 \,.\, 2800$ G $= 3800$ G ${}_JH_C = 2800$ Oe $$\frac{(4\pi J \cdot H)_{max}}{4\pi J_S \cdot {}_JH_C} > 0.6$$

This material was prepared as follows:

840 g of $Fe_2O_3$, 98 g of $SrCO_3$, 52 g of $BaCO_3$, and 10 g of $Na_2CO_3$ were intimately mixed, and the mixture was heated at 1300° C for 1 hour. Then the obtained ferrite was cooled and ground for 20 hours in a ball mill with water to a powder having a particle in the range of about 1 to $5 \cdot 10^{-3}$ mm. After 18 hours grinding, 10 g of lead monosilicate were added. The obtained particles consisted of single magnetic domains and were anisotropic.

The obtained powder was mixed with 50 per cent by weight of water and placed in a die while applying thereto a strong magnetic field of about 5000 Oe so as to have the ferrite particles magnetically oriented in the direction of said field. On compacting the powder, the water is drained through filters built into the die. Such magnetic materials are well known in the art and the foregoing method of making them forms no part of this invention.

Samples of the obtained pressed bodies were sintered at different temperatures: by determining the demagnetization curves of such bodies for the temperatures of 1220°, 1260°, and 1280° C, the optimum temperature of 1260° was established and the magnetic bodies were heated at said temperature for 1 hour until they had just reached their maximum density, which corresponded to optimum coercivity. The bodies then had the following values; a remanence $B_r$ of 3800 G, a coercivity ${}_JH_C$ of 2800 Oe, and a fullness factor of $$\frac{(4\pi J \cdot H)_{max}}{4\pi J_S \cdot {}_JH_C} = \frac{3400 \cdot 2660}{3800 \cdot 3000} = 0.8$$

Said bodies were ground to a powder of a particle size of 0.05 to 0.25 mm, and the powder was then mixed with 3 percent of finely ground epoxy resin binder and pressed cold in a magnetic field of 5,000 Oe to a body which, after removal from the die, was solidified by heating for ½hour at 140° C, whereby the body substantially retained its dimensions. The pressure used was about 5 tons per $cm^2$.

The thus obtained magnet has the following properties:

$B_r = 2800$ G;

${}_JH_C = 2900$ G;

$(B \cdot H)_{max} = 166.10^6 G \cdot Oe$.

These values are considerably higher than those measured in pressed magnets at present available in commerce, as represented by curve c.

By raising the pressure to 8.5 tons per $cm^2$, even a $(B \cdot H)_{max}$ of $2.10^6 G \cdot Oe$ was obtained.

The procedure illustrated by the example can be similarly applied to other permanent magnetic compounds, particularly also to Alnico alloys containing more than 30% of cobalt.

I claim:

1. Method of producing a permanent magnet body, comprising the steps of:

a. producing anisotropic first ferromagnetic permanent magnet material by sintering particles of starting material suitable for making permanent magnets at a preselected optimum temperature;

b. terminating said heating when said sintered magnet material has reached full remanence;

c. grinding said sintered first ferromagnetic permanent magnet material to a powder, the particles of said ground powder having the following characteristics:

1. coercivity ${}_JH_C$ below the maximum obtainable value for said particles and at least equal to the remanence of the finally produced magnet body;

2. remanence $4\pi J_R$ between 1.2 and 1.6 times the remanence $B_R$ of the finally produced magnet body, and;

3. a fullness factor $$\frac{(4\pi J \cdot H)_{max}}{4\pi J_S \cdot {}_JH_C}$$

of at least 0.6;

d. mixing said powder particles with a curable non-magnetic binder;

e. compacting said powder particles and binder under pressure and under the influence of a magnetic field in a machine to form the shape and size of the final magnet body:

f. removing said shaped and compacted body from the forming machine, and;

g. heating said compacted magnet body at a temperature and for a period of time to cure the binder but insufficient to significantly change the dimensions of said body.

2. The method of claim 1, wherein said binder is an organic binder and the temperature of step (g) is sufficient only to solidify said binder without sintering the body.

3. The method of claim 2, wherein the time of heating of step (g) is approximately ½ hour.

4. The method of claim 1, wherein the ground particles of step (c) comprise a ferrite.

5. The method of claim 1, wherein the ground particles of step (c) comprise a Co-Y alloy.

6. The method of claim 4, wherein the coercivity of said formed body equals at least 2800oe. and the remanence is within the range of between 1.3 and 1.5 × 2800 G.

7. The method of claim 1, wherein the particles are ground during step (c) to sizes within the range of between 0.05 and 0.25mm.

* * * * *